US005836580A

United States Patent [19]

Hansen et al.

[11] Patent Number: 5,836,580

[45] Date of Patent: Nov. 17, 1998

[54] SINGLE TRAY AND MULTI TRAY MISFEED DETECTOR WITH VOLTAGE RESPONSE ADJUSTMENT

[75] Inventors: Paul Hansen, Westminster; Sheldon F. Raizes, Rancho Palos Verdes, both of Calif.

[73] Assignee: Xerox Corporation, Stamford, Conn.

[21] Appl. No.: 782,323

[22] Filed: Jan. 13, 1997

[51] Int. Cl.[6] ..... B65H 3/44

[52] U.S. Cl. ..... 271/9.13; 271/9.01; 271/263; 271/265.04; 271/265.02

[58] Field of Search ..... 271/3.03, 3.13, 271/9.01, 9.13, 263, 259, 265.04, 265.02, 265.01

[56] References Cited

U.S. PATENT DOCUMENTS

| | | | |
|---|---|---|---|
| 5,105,078 | 4/1992 | Nochise et al. | 271/263 |
| 5,503,382 | 4/1996 | Hansen et al. | 271/3.03 |
| 5,584,472 | 12/1996 | Hidding et al. | 271/3.03 |
| 5,586,755 | 12/1996 | Hansen | 271/3.03 |
| 5,769,407 | 6/1998 | Hansen | 271/265.04 |

*Primary Examiner*—H. Grant Skaggs
*Attorney, Agent, or Firm*—Sheldon Raizes

[57] ABSTRACT

A single tray or multi tray sheet feed system is provided. A sensor is provided to sense the sheets leaving from the single tray or multi tray system. If the paper weight of sheets of paper on a tray fall within a first range of paper weight values, the sensor is designed to have a first given voltage response condition for sensing these sheets and if the paper weight of the sheets falls within a second range of paper weight values the sensor is designed to have a second given voltage response condition for sensing the latter sheets. A current value supplied to the emitter of the sensor can be controlled to provide the desired voltage response or a resistance in a phototransistor collector circuit can be varied to provide the desired voltage response condition. If the first range of paper weight values is lighter than the second range of paper weight values, the sensor, when in the first given voltage response condition, will have a voltage response, when sensing a sheet of a given paper weight, which is higher than the voltage response when the same sensor senses a sheet of the same paper weight, when the sensor is in the second given voltage response condition. A voltage response value sensed by the sensor of the first sheet fed from a tray is stored in memory as the voltage response value for all sheets on that particular tray. The voltage response value sensed by the same sensor of subsequent sheets fed from that particular tray is compared with the voltage response value in memory to detect a multi sheet feed from the tray.

3 Claims, 7 Drawing Sheets

SINGLE TRAY AND MULTI TRAY MISFEED DETECTOR WITH VOLTAGE RESPONSE ADJUSTMENT

This application is related to U.S. application Ser. No. 08/782,324 entitled Multi Tray and Buffer Tray Misfeed Detector with Voltage Response Adjustment, filed concurrently herewith and now U.S. Pat. No. 5,806,843, and U.S. application Ser. No. 08/769,407, entitled Misfeed Detector with Voltage Response Adjustment, filed concurrently herewith and now U.S. Pat. No. 5,769,407. Each of these applications is assigned to the assignee of this application.

BACKGROUND

This invention relates to a system for detecting a multi-sheet feed from paper trays.

It is common to employ a sheet feeder with laser printers. The sheets are fed from the sheet feeder tray to the printer. It is important that only one sheet at a time be fed from the tray and if more than one sheet is fed from the tray, that it be detected immediately and the system can be either shut down to correct the situation or the offending sheets be sent to a purge tray at the printer without shutting down the system. The thickness of each sheet fed from the tray is sensed by a sensor and the thickness value sensed is compared to a thickness value for a single sheet in memory. If the thickness values match, then only one sheet has been fed from the tray. If the thickness value is more that the thickness value in memory, then that indicates that more than one sheet has just left the tray.

The sensor comprises an emitter and a phototransistor between which the sheets of paper pass. The emitter emits light rays through the sheets of paper that are sensed by the phototransistor. It is common to supply a given fixed current to the emitter when sensing sheets passing through the sensor even though the sheets sensed may vary significantly in paper weight. This causes a problem at certain paper weights since the difference between voltage response at the phototransistor for a single sheet and the voltage response for two sheets, each of the same paper weight as the single sheet, fed through the sensor can be small enough that the voltage responses can overlap due to imperfections in the paper, images that are on preprinted paper, misalignment between the emitter and phototransistor, and response variations between different phototransistors. This could cause false detections of double fed sheets.

Therefore, it is an object of this invention to provide a large enough difference between the voltage response at the phototransistor for a single sheet and the voltage response for two sheets, each of the same paper weight as the single sheet, fed through the sensor to avoid any overlap due to imperfections in the paper, images that are on preprinted paper, misalignment between the emitter and phototransistor, and response variations between different phototransistors.

SUMMARY OF INVENTION

In accordance with this invention, if the paper weight of sheets of paper on a tray falls within a first range of paper weight values, a sensor is designed to have a first given voltage response condition and if the paper weight of the sheets falls within a second range of paper weight values the sensor is designed to have a second given voltage response condition. A current value supplied to the emitter of the sensor can be controlled to provide the desired voltage response or a resistance in a phototransistor collector circuit can be varied to provide the desired voltage response condition. If the first range of paper weight values is lighter than the second range of paper weight values, the sensor, when in the first given voltage response condition, will have a voltage response, when sensing a sheet of a given paper weight, which is higher than the voltage response when the same sensor senses a sheet of the same paper weight, when the sensor is in the second given voltage response condition. This way the difference between a voltage response at the phototransistor for a single sheet and a voltage response for two sheets, each of the same paper weight as the single sheet, fed through the sensor is large enough throughout all paper weight ranges to obviate the possibility of voltage response overlap.

DETAILED DESCRIPTION OF THE INVENTION

Figure 1:
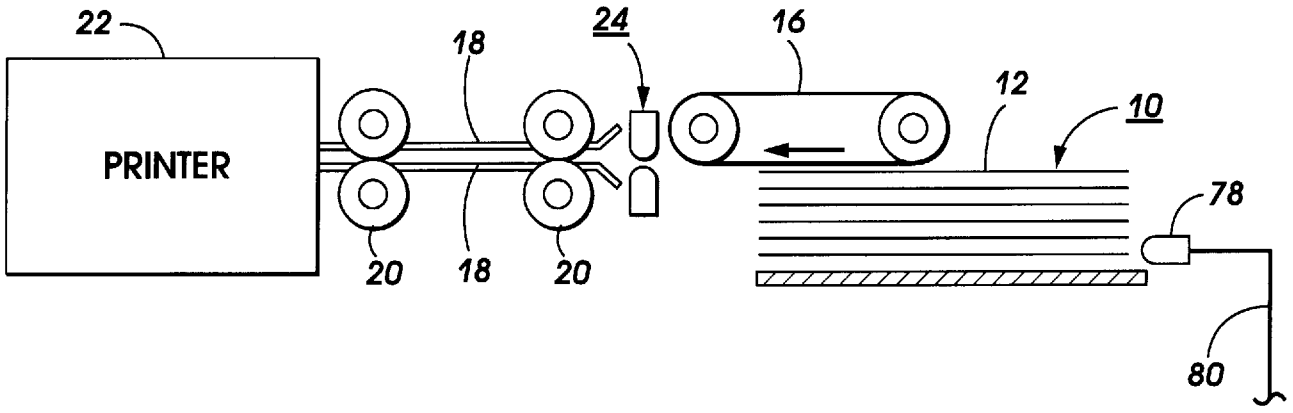
FIG. 1 is a schematic view of a single tray printing system.

Referring to FIG. 1, there is shown a printing system comprising a feed tray 10, having a plurality of sheets 12 stacked therein. The sheets are all of the same thickness or paper weight. A vacuum sheet transport belt conveyor 16 transports a sheet to a guide 18 where a plurality of driven nip rolls 20 move a sheet through the guides from which the sheet enters a laser printer 22 where an image is transferred to each sheet. Sensor 24 is located between the tray 10 and the guide 18 for sensing the thickness or paper weight of the sheets 12 as they are fed from the tray 10. The thickness of a sheet of paper is a function of the paper weight of the sheet. For instance, a thick sheet of paper will have a heavier paper weight than a thin sheet.

Figure 2:
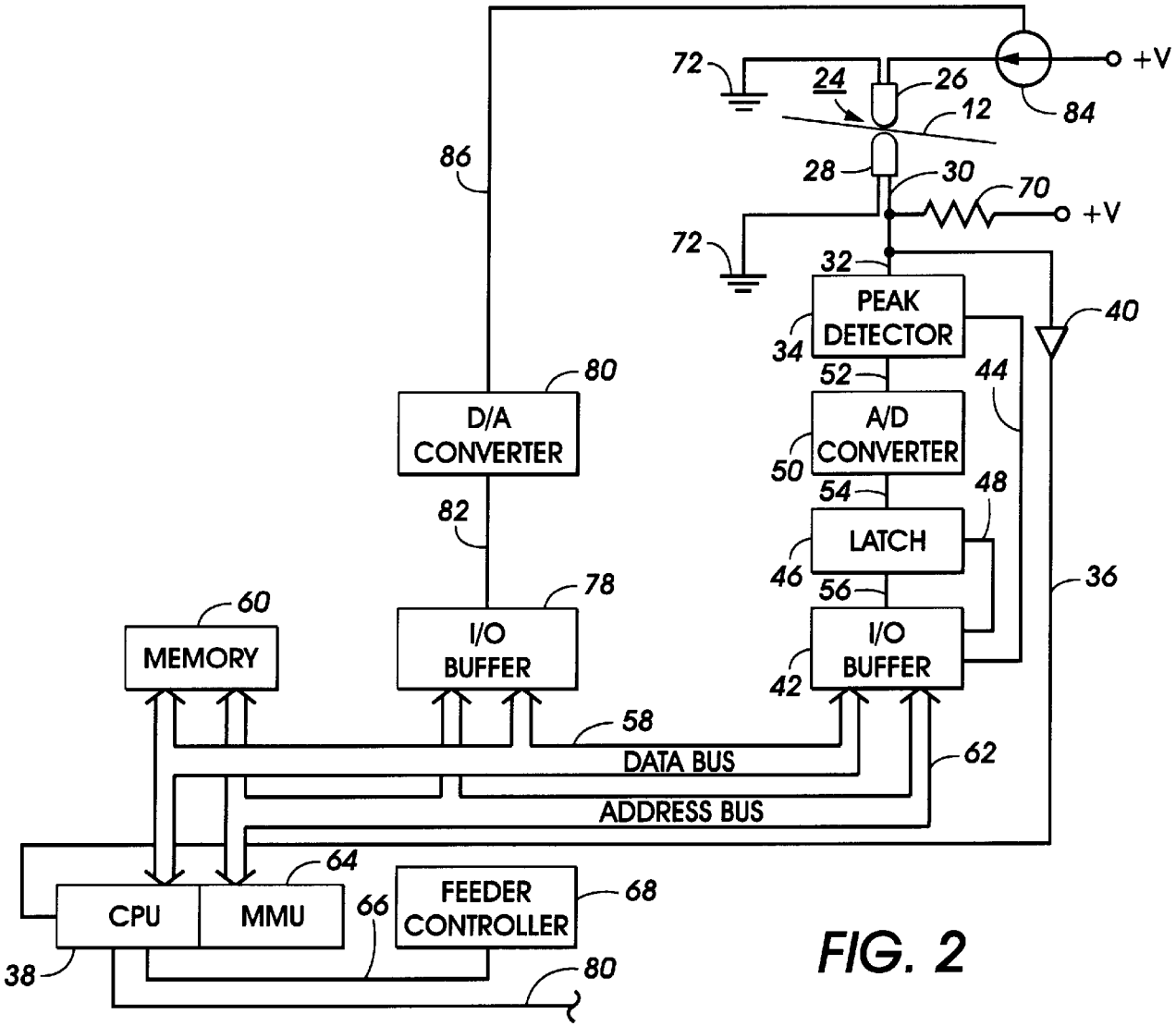
FIG. 2 is a block schematic diagram of a multi-sheet feed detector operating system embodying this invention for the printing system illustrated in FIG. 1.

Referring to FIG. 2, there is shown a schematic of a sheet thickness sensing arrangement for tray 10. The inlet sensor 24 comprises an infrared emitter 26 and a phototransistor 28. Any type of emitter can be used, but infrared is preferred. The collector 30 of the phototransistor 28 is connected through a control line 32 to a peak detector 34 and through control line 36 to a CPU (central processing unit) 38. A positive transition detector 40 is located in control line 36 between the phototransistor 28 and the CPU 38 and detects sudden voltage changes at the collector 30. The peak detector 34 detects a peak voltage at collector 30 and is connected to an I/O (Input/output) buffer 42 through a control line 44 to allow the CPU to reset the peak detector to zero. A latch 46 is connected to the I/O buffer 42 through a control line 48 to allow the CPU to implement a data latch function. An A/D (analog/digital) converter 50 is connected to the peak detector 34 by line 52 and to the latch 46 by a data line 54. A data line 56 connects the latch 46 to the I/O buffer 42. A data bus 58 links the CPU 38 with the I/O buffer 42, an I/O buffer 78 and memory 60. The memory 60 is a two part memory having a RAM and an EPROM. An address bus 62 links a MMU (memory management unit) 64 with the I/O buffers 42,78 and the memory 60. The CPU 38 is connected through a control line 66 to a feeder controller 68 for controlling feeding of the sheets from the tray 10.

The I/O buffer 78 is connected to a digital to analogue (D/A) converter 80 by a data line 82. The D/A converter 80 is connected to a current source 84 for the emitter 26 by a current control line 86. The CPU 38 addresses the I/O buffer 78 by the address bus 62 and sends a value of current to the buffer 78 by data bus 58. The buffer 78 sends that value to the D/A converter 80 over the data line 82 and that value is converted by the D/A converter 80 to an analogue signal that is transmitted to the current source 84 by current control line 86 to supply a given current to the emitter 26.

The amount of current that flows through the phototransistor 28 is a function of the amount of light to which a phototransistor is exposed. If the exposure to light is increased, more current will flow and if the exposure to light is decreased, less current will flow. The emitter 26 emits rays towards the base of the phototransistor 28 and strikes phototransistor at maximum intensity when a sheet of paper is not between the emitter and the phototransistor. Therefore, there is maximum current flow across a resistor 70 when a sheet of paper is not between the emitter and the phototransistor and the voltage difference between a ground 72 and the collector 30 of the phototransistor 28 is at its lowest value in this condition.

When a sheet of paper passes between the emitter 26 and the phototransistor 28, light from the emitter will pass through the sheet of paper with the amount of light passing through being dependent upon the thickness or paper weight of the paper. More light will pass through a thin sheet than a thick sheet. Since a phototransistor is exposed to less light when a sheet of paper is passing between the emitter and the phototransistor, less current flows through the resistor 70 and the voltage difference between the collector 30 and ground 72 increases. The voltage difference between ground 72 and a collector 30 will increase in accordance with an increase in the thickness of a sheet since the amount of light to which a phototransistor is exposed decreases as the thickness of a sheet sensed increases.

There is a problem with measuring the flow of light through the sheets of paper. If the voltage difference between the voltage response of the phototransistor 28 to light passing through one sheet of paper of a given paper weight and the voltage response to light passing through two sheets of paper of the same given paper weight is small, then the voltage responses could overlap due to imperfections in the paper, images that are on preprinted paper, misalignment between the emitter and phototransistor, and response variations between different phototransistors. This could cause false detections of double fed sheets.

Figure 3:
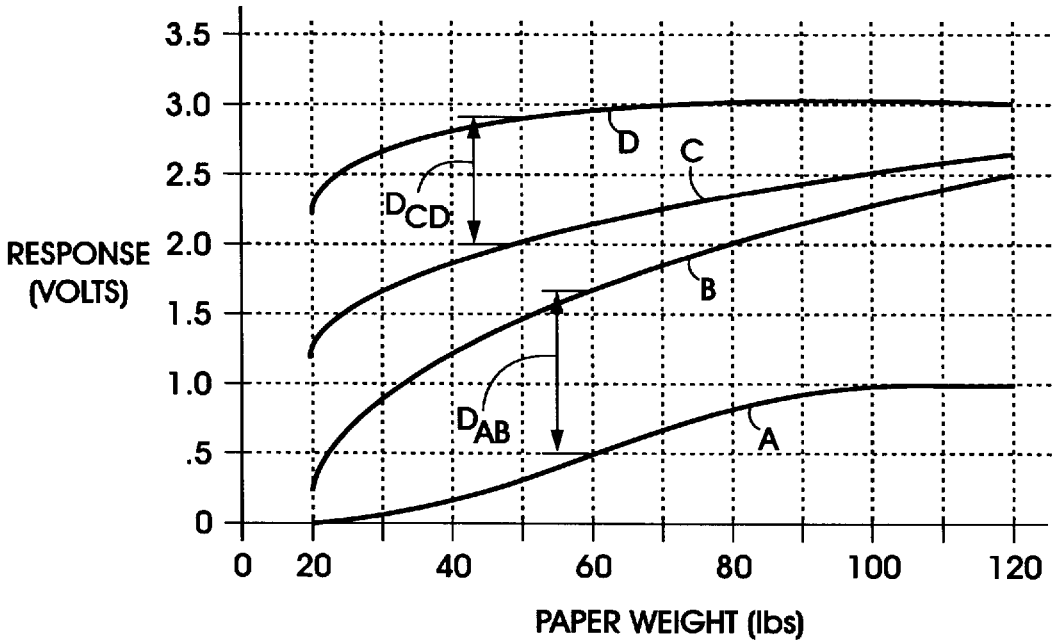
FIG. 3 is a graph of two sets of curves illustrating voltage response at the phototransistor for single sheets and double sheets depending upon the current supplied to the emitter and the paper weight of the single sheet measured and double sheet measured.

Referring to FIG. 3, there is shown a graph of four curves of a paper weight/voltage response relationship utilizing two different current values for the emitter 26 of the sensor 24. Curve A represents the voltage response (vertical axis) when a single sheet at different weights (horizontal axis) is passed across the sensor 24 and a current of 25 millamps is supplied to the emitter 26 of sensor 24. Curve B represents the voltage response when two sheets, each of which is of the weight indicated along the horizontal axis for a single sheet, are passed across the sensor 24 and a current of 25 millamps is supplied to the emitter 26 of sensor 24. Curve C represents the voltage response when a single sheet at different weights is passed across the sensor 24 and a current of 12 millamps is supplied to the emitter 26 of sensor 24. Curve D represents the voltage response when two sheets, each of which is of the weight indicated along the horizontal axis for a single sheet, are passed across the sensor 24 and a current of 12 millamps is supplied to the emitter 26 of sensor 24.

From looking at curves A and B, one can see that the difference $D_{AB}$ between the voltage responses for a single sheet with a paper weight of 20 lbs. and two sheets, each of which is a paper weight of 20 lbs., is about 0.3 volt; the difference between the voltage responses for a single sheet with a paper weight of 30 lbs. and two sheets, each of which is a paper weight of 30 lbs., is about 0.75 volt; and the difference between the voltage responses for a single sheet with a paper weight of 40 lbs. and two sheets, each of which is a paper weight of 40 lbs., is about 1 volt. From inspection of the two curves A and B, one can see that the difference $D_{AB}$ between the voltage responses for a single sheet and two sheets continues to expand to 1.5 volts through a single sheet of a paper weight of 120 lbs. and two sheets, each of which is a paper weight of 120 lbs. It should be recalled that these two curves, A and B are generated using 25 milliamps at the emitter 26.

From looking at curves C and D, one can see that the difference $D_{CD}$ between the voltage responses for a single sheet with a paper weight of 20 lbs. and two sheets, each of which is a paper weight of 20 lbs., is about 1 volt; the difference between the voltage responses for a single sheet with a paper weight of 30 lbs. and two sheets, each of which is a paper weight of 30 lbs., is about 1 volt; and the difference between the voltage responses for a single sheet with a paper weight of 40 lbs. and two sheets, each of which is a paper weight of 40 lbs., is about 0.9 volt. From inspection of the two curves C and D, one can see that the difference $D_{CD}$ between the voltage responses for a single sheet and two sheets continues to decrease to about 0.4 volt through a single sheet of a paper weight of 120 lbs. and two sheets, each of which is a paper weight of 120 lbs. It should be recalled that these two curves, C and D are generated using 12 milliamps at the emitter 26.

Single sheet paper weight of 20 lbs. is the most popular paper used and one can see that by obtaining a high voltage response for this weight of paper, it would be the most beneficial when compared to obtaining a low voltage response at this weight since there is an approximate 1 volt difference between a high voltage response (see curves C and D) for a single sheet of a 20 lb. weight and a high voltage response for two sheets, each of which is 20 lb. weight whereas the difference when there is a low voltage response (see curves A and B) is about 0.3 volt.

It can also be appreciated that when sheets of paper of a heavier weight are used, it is more beneficial to obtain a low voltage response, since for instance for a sheet of a paper weight of 60 lb. there is an approximate 1.25 volt difference between the low voltage response (see curves A and B) for a single sheet of a 60 lb. paper weight and a low voltage response for two sheets, each of which is a 60 lb. paper weight, whereas the difference when there is a high voltage response (see curves C and D) is about 0.75 volt. The advantage of a low voltage response for heavier sheets of paper is even greater when a sheet of a paper weight of 100 lb. or heavier weight is used since there is an approximate 1.5 volt difference between a low voltage response for a single sheet of a 100 lb. paper weight and a low voltage response for two sheets, each of which is 100 lb. paper weight, whereas the difference when there is a high voltage response (see curves C and D) is about 0.5 volt.

It follows that it would be most desirable to use a voltage response around 1.25 to 1.65 volts for sheets of a paper weight of less than about 30 lbs. and to use a voltage response of 0.25 volt for sheets of a paper weight that are above 30 lbs. in order to obtain maximum voltage differential between the voltage response to a single sheet of a given paper weight and the voltage response to two sheets of the same given paper weight. However, it is not desirable to use a voltage response for a single sheet until the voltage response level starts approaching about 0.4 volt. Otherwise the voltage response is too close to zero level to obtain significant confidence in the response level. Therefore, one might desire to use a voltage response in a range of about 0.4 volt to 1 volt at the sensors for sheets with a paper weight starting at between the range of 50 to 60 lbs. and above and use a voltage response in the range of about 1.25 to 2 volts at the sensors for sheets with a paper weight below the range of 50 to 60 lbs.

Therefore, it is preferable to have the difference between a voltage response at the phototransistor for a single sheet and a voltage response for two sheets, each of the same paper weight as the single sheet, fed through the sensor to be large enough throughout all paper weight ranges to obviate the possibility of voltage response overlap. This can be accomplished by providing a sensor which is capable of being in a first given voltage response condition for sensing sheets of a first given paper weight range and a second given voltage response condition for sensing sheets of a second paper weight range which is heavier than the first range. The voltage response conditions will be such that when the sensor is in the first given voltage response condition, the sensor will have a voltage response, when sensing a sheet of a given paper weight, which is higher than the voltage response when the sensor is in the second given voltage response condition and senses a sheet of the same paper weight.

Assume that a desirable characteristic of a sensor would be to have a sensor obtain a voltage response when sensing single sheets with a paper weight range up to and including 50 lbs. which would be more than the voltage response when sensing single sheets with a paper weight range above 50 lbs. One would then calibrate the sensor by picking out a voltage response that would be desired at a particular paper weight in each range and then adjust the current to the emitter to obtain that voltage response. For instance, a sheet of a paper weight of 20 lbs. would be passed through a sensor to obtain a desired voltage response of 1.25 volts. According to curve C in FIG. 3, the current that would be supplied to the emitter is 12 milliamps to obtain the voltage response of 1.25 volts. Depending upon the alignment between the emitter and the phototransistor and the response characteristics of the phototransistor, the 12 milliamps may or may not supply the desired 1.25 volts and the current may have to be adjusted accordingly to obtain such. The calibration can be performed manually.

After the sensor is calibrated for the sheet of 20 lb. paper weight, a sheet of a paper weight of 60 lbs. is passed through a sensor to obtain a desired voltage response of 0.5 volt. According to curve A in FIG. 3, the current that would be supplied to the emitter is 25 milliamps to obtain the voltage response of 0.5 volt. Depending upon the alignment between the emitter and the phototransistor and the response characteristics of the phototransistor, the 25 milliamps may or may not supply the desired 0.5 volt and the current may have to be adjusted accordingly to obtain such.

Assuming that 12 milliamps and 25 milliamps satisfy the voltage response of the sensor to sense sheets of a paper weight of 20 lbs. and 60 lbs., respectively, then 12 milliamps would be supplied to the emitter when sheets with a paper weight range up to and including 50 lbs. are sensed and 25 milliamps would be supplied to the emitter when sheets with a paper weight range above 50 lbs. are sensed. This sets the sensor to be in a first voltage response condition (when 12 milliamps are supplied to the emitter) having a voltage response, when sensing a sheet of a given paper weight, which is higher than a voltage response when the sensor senses a sheet of the same paper weight, when the sensor is in a second voltage response condition (when 25 milliamps is supplied to the emitter).

If a different voltage response was desired for a sheet of a paper weight of 20 lbs., such as 1 volt, then one can see from curves A and C in FIG. 3 that the current to be supplied to the emitter sensor to obtain such voltage response would fall between 12 and 25 milliamps. Similarly, if the voltage response was desired for a sheet of a paper weight of 60 lbs. was 0.75 volt, the current to be supplied to the emitter of the sensor to obtain such response would fall between 12 and 25 milliamps.

Figure 4:
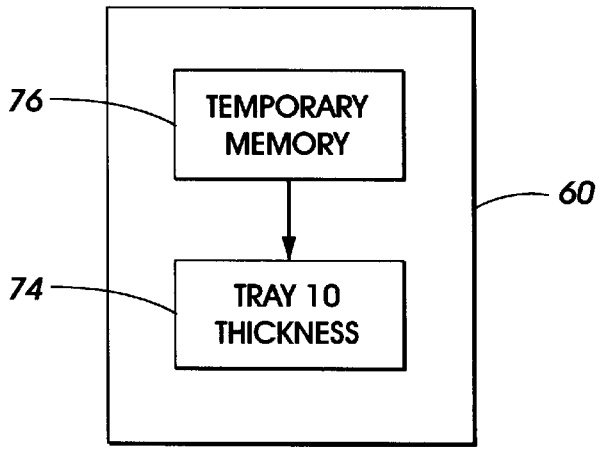
FIG. 4 is a block schematic diagram of a portion of a RAM memory of the schematic of FIG. 2.

The Ram section of the memory 60 is shown in FIG. 4. There is a memory location 74 for storing the voltage response value at the phototransistor 28 which represents the thickness value of the sheets in tray 10. The sensed thickness value of the first sheet fed from the tray 10 is put into this location. There is also a temporary memory location 76 for storing the thickness values sensed by sensor 24 of all other sheets fed from the tray 10. Each memory location contains a plurality of memory sites, depending upon the number of samplings taken during sensing of a sheet.

Using the above illustration and assuming that the paper weight ranges and the voltage response conditions are the same, the system can be set up as follows: The CPU 38 is programmed to communicate to the I/O buffer 78 the value of 12 milliamps for the initial current to be supplied to the emitter 26 for the first sheet of paper 12 that is passed through the sensor 24. The CPU 38 is also programmed to supply a current of 12 milliamps to the emitter 26 for measuring the thickness of sheets that have a paper weight up to and including 50 lbs. and to supply a current of 25 milliamps to the emitter 26 for measuring the thickness of sheets that have a paper weight above 50 lbs. A voltage response value which corresponds to a voltage response at the phototransistor 28 for a sheet of a 50 lb. paper weight when 12 milliamps is supplied to the emitter 26 is stored in the EPROM. The EPROM contains a program which compares the voltage response value of the first sheet sensed from tray 10 with the stored voltage response value. If the voltage response of the first sheet is equal to or less than the stored value, the program will instruct the CPU 38 to input a value of 12 milliamps to the buffer 78 and if the voltage response of the first sheet is above the stored value, the program will instruct the CPU to input a value of 25 milliamps to the buffer 78.

The EPROM also contains a program for controlling measurement and storage of thickness values of the sheets 12 arriving at the sensor 24 from the tray 10 and for comparison of the thickness values for detecting a double sheet feed from the tray 10.

The CPU 38 is programmed to keep track of the sheets as they are fed from the tray 10 until after they pass through the sensor 24 and place the sensed thickness values in memory locations 74 and 76 and compare the values in such memory locations.

Referring to FIG. 1, the tray 10 has a sensor 78 connected thereto for sensing when the tray has been lowered for refilling. The sensor 78 is communicated to the CPU 38 by a control line 80. The sensor may be a contact switch, a push button switch or any other well known sensing device. When the tray 10 is lowered, the sensor causes an interrupt through the control line at the CPU 38. The CPU 38 is programmed to respond to the interrupt to clear the memory location 74 and start the program for placing in memory location 74 the thickness value of the first sheet sensed that is fed from tray 10 after it is reloaded and to clear the I/O buffer 78 and send the value of the initial current of 12 milliamps to the I/O buffer 78 which is transmitted to the current source 84 to supply the emitter 26 with the initial current of 12 milliamps for measuring the thickness value of the first sheet sensed that is fed from tray 10 after it is reloaded.

In operation, the CPU 38 is programmed to transmit to the I/O buffer 78 the initial current value (12 milliamps) which is then transmitted to the current source 84 to supply 12 milliamps to the emitter 26. When a first sheet 12 is fed from tray 10 and introduced into the sensor 24, there will be a sudden voltage change at the collector 30 which is sensed by the positive transition detector 40 which causes an interrupt through the control line 36 at CPU 38. The CPU is programmed to only respond to the initial interrupt and ignore any subsequent interrupts until after the sheet of paper has left the sensor 24. In response to the initial interrupt, the CPU, in conjunction with the MMU 64, addresses the I/O buffer 42 which immediately resets the peak detector 34. The voltage at collector 30 can be sampled only once per sheet or a plurality of times as the sheet passes through the sensor. Sampling the sheet thickness once has a drawback if the sheet has an opaque portion or, if it is a preprinted form, has light and dark printing on it, since, if any of these are sensed, an incorrect reading of the thickness of a sheet will occur. Therefore it is desirable to sample the thickness of the sheet at more than one location. For example, the sheet can be sampled six times as the sheet passes through the sensor 24. Assuming that the sheet is 8½×11 inches and the 11 inch edge is the leading edge into the sensor 24, and the sheet passes across the sensor 24 at a speed of 65 inches per second, each sheet section sensed before sampling will be 1.4 inches and sampling will occur every 22 milliseconds.

The peak detector senses the voltage at collector 30 as the sheet passes between the emitter 26 and the phototransistor 28 with this voltage representing the thickness of the sheet. The voltage at the peak detector 34 is inputted to the A/D converter 50 in analog form and this is converted to digital form by the A/D converter 50 and sent to the latch 46. The first sensing will be completed by a first sampling taken 22 milliseconds after entry of the sheet into the sensor 24. The latch will be set at 22 milliseconds to capture the peak voltage in peak detector 34 and the peak detector reset immediately thereafter for detecting the voltage over the next 1.4 inches of the sheet. Some time between the expiration of the first 22 milliseconds and the expiration of the next 22 milliseconds, the I/O buffer 42 will send the voltage information for the first sampling of the sheet to the memory 60. The same cycle is repeated until after the sixth 1.4 inch section is sampled. When a new sheet is introduced into the sensor 24, the sudden voltage change at the collector 30 is sensed by the positive transition detector 40 which causes an interrupt at the CPU 38 and the same cycle is repeated for the new sheet.

After the sixth 1.4 inch section of the sheet 12 is sampled while the sheet passes through sensor 24, the six sampled values of the first sheet 12 from the tray 10 are placed into memory location 74. This thickness or voltage response value is compared to the voltage response value stored in the EPROM to determine if the paper weight of the sheet is at, below or above 50 lbs. to select the appropriate current to be supplied to the emitter 26 for sensing subsequent sheets. This can be achieved by comparing the sum of the six sensed values in memory location 74 with the sum of the six sensed values stored in the EPROM. If the sum of the voltage response of the first sheet is equal to or less than the stored value, the paper weight of the sheet is at or below 50 lbs. If the sum of the voltage response of the first sheet is above the stored value, the paper weight of the sheet is above 50 lbs.

When the appropriate current value is selected, the CPU 38 is programmed to respond to such selection and input to the I/O buffer 78 the current value to be supplied to the emitter 26 for sensing subsequent sheets fed from tray 10. If the current to be supplied to the emitter for sensing subsequent sheets is 12 milliamps, then the thickness value which was placed in memory location 74 will stay in that location as the thickness value for all of the remaining sheets in tray 10. If the current to be supplied to the emitter for subsequent sheets is 25 milliamps, then the CPU 38 is programmed to clear the thickness value placed in memory location 74 and place the thickness value of the next sheet sensed by the sensor 24 in memory location 74.

The thickness value sensed for all subsequent sheets fed from tray 10 will be compared to the thickness value in memory location 74. The thickness value in memory location 74 will stay in memory location 74 until the tray 10 is lowered to refill the tray at which time the sensor 78 will cause an interrupt through control line 80 at the CPU 38 and the current thickness value is cleared from memory location 74. The thickness value sensed by sensor 24 of the first sheet fed from the tray 10, after the tray 10 has been refilled and after the memory location 74 has been cleared, will be placed into the memory location 74 as the new thickness value for all of the remaining new sheets 12 loaded onto tray 10. The current value for emitter 26 will stay in I/O buffer 78 until the tray 10 is lowered to refill the tray at which time the CPU 38, in response to the interrupt through control line 80, will clear the value from I/O buffer 78 and communicate the value of the initial amount of current (12 milliamps) to the I/O buffer which results in 12 milliamps being supplied to the emitter 26 for sensing the first sheet fed from the tray 10 after it has been refilled.

When a subsequent sheet 12 is fed from the tray 10, it is sensed by sensor 24 in the same manner as the first sheet was and after the sixth 1.4 inch section of a sheet 12 is sampled while the sheet passes through sensor 24, the six sampled values of the sheet are temporarily placed into memory location 76 and those values are compared with the six sampled values of the first sheet from the tray 10 that are in memory location 74. This can be achieved by comparing the sum of the six sensed values in memory location 76 with the sum of the six sensed values in memory location 74. If the sums are within a chosen tolerance of each other, it will be assumed that only one sheet has passed through the sensor 24 and normal operation of the printing system will continue. If the sum of the six sensed values, which is located in memory location 74, for the first sheet is less than the sum of the six sensed values, located in memory location 76, of a subsequent sheet fed from tray 10 by more than a chosen tolerance, then such will indicate a greater sheet thickness for the subsequent sheet than the first sheet. Thus, it will be assumed that more than one sheet has passed through the sensor 24 and a signal will be sent by the CPU 38 over the control line 66 to the feeder controller 68 to immediately stop the sheet feeding system. A system operator can then remove the double fed sheets and reset the system to resume normal operation. Alternatively, a signal can cause the offending sheets to be sent to a purge tray at the printer without stopping the sheet feeding system.

Figure 5:
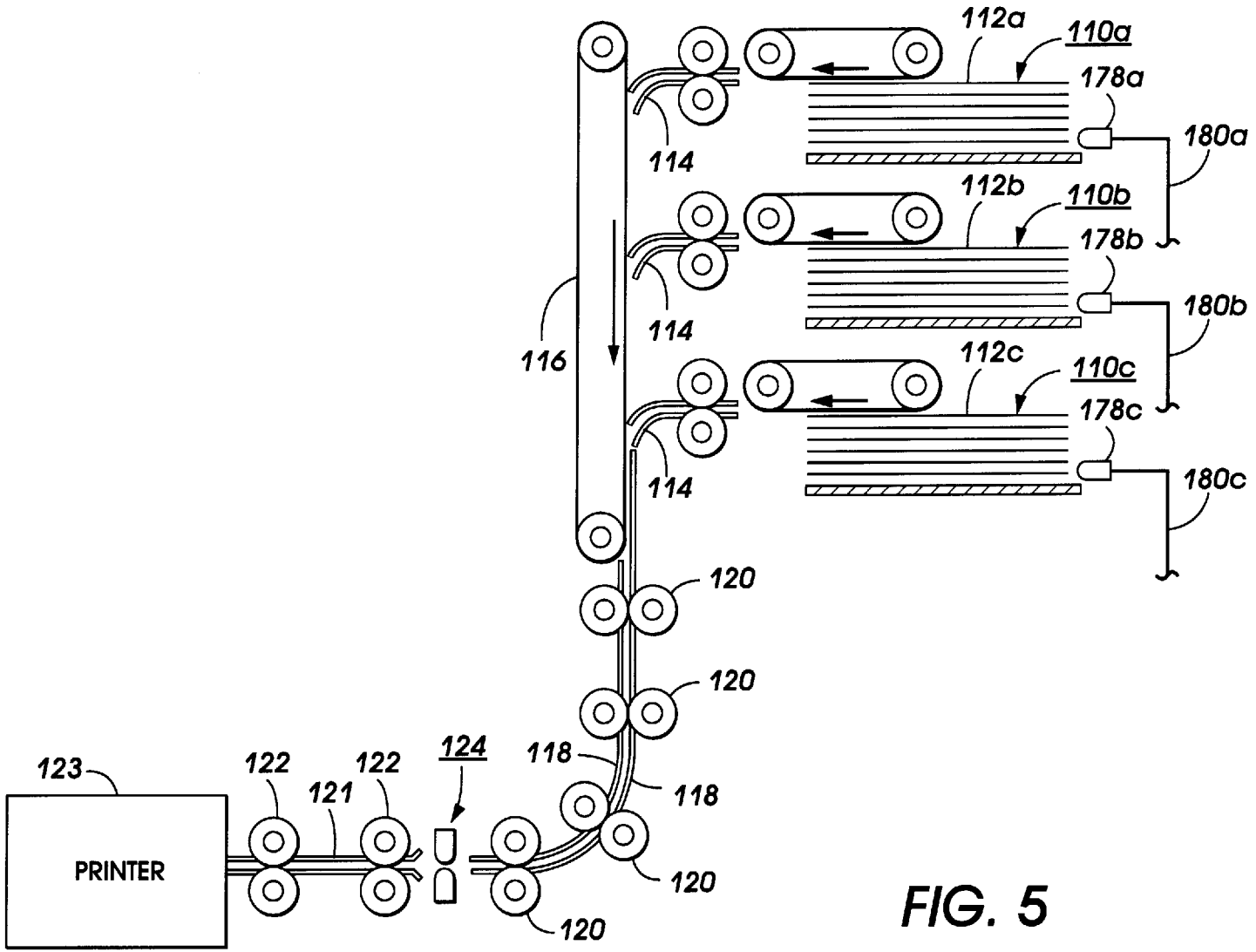
FIG. 5 is a schematic view of a multi-tray printing system.

Referring to FIG. 5, there is shown an alternative embodiment to the system disclosed in FIG. 1. In this embodiment, there are three trays and a sheet thickness sensor is placed at the end of a transport system for conveying sheets from each of the three trays. The printing system comprises three trays 110*a*, 110*b*, and 110*c*, each having a plurality of sheets 112*a*, 112*b*, and 112*c*, respectively, stacked therein. The sheets in each tray are of the same thickness as the others in the same tray, but may be a different thickness than the sheets in the other trays. A sheet feeding apparatus 114 is provided for each feed tray and a common vacuum sheet transport belt conveyor 116 transports a sheet to guides 118 where a plurality of driven nip rolls 120 move a sheet through the guides 118 to guides 121 which have driven nip rolls 122 from which the sheets enter a laser printer 123 where an image is transferred to each sheet. A sensor 124 is located between the guides 118 and 121 for sensing the thickness of the sheets 112*a*, 112*b* and 112*c* as they are fed from their respective trays to the printer 123.

Referring to 6, there is shown a schematic of a sheet thickness sensing arrangement. The sensor 124 comprises an infrared emitter 126 and a phototransistor 128. The collector 130 of the phototransistor 128 is connected through a control line 132 to a peak detector 134 and through control line 136 to a CPU (central processing unit) 138. A positive transition detector 140 is located in control line 136 between the phototransistor 128 and the CPU 138 and detects sudden voltage changes at the collector 130. The peak detector 134 detects a peak voltage at collector 130 and is connected to an I/O (Input/output) buffer 142 through a control line 144 to allow the CPU to reset the peak detector to zero. A latch 146 is connected to the I/O buffer 142 through a control line 148 to allow the CPU to implement a data latch function. An A/D (analog/digital) converter 150 is connected to the peak detector 134 by line 152 and to the latch 146 by a data line 154. A data line 156 connects the latch 146 to the I/O buffer 142. A data bus 158 links the CPU 138 with the I/O buffer 142, an I/O buffer 190 and memory 160. The memory 160 is a two part memory having a RAM and an EPROM. An address bus 162 links a MMU (memory management unit) 164 with the I/O buffers 142 and 190 and the memory 160. The CPU 138 is connected through a control line 166 to a feeder controller 168 for controlling feeding of the sheets from the trays 110*a*, 110*b* and 110*c*.

The I/O buffer 190 is connected to a digital to anologue (D/A) converter 192 by a data line 194. The D/A converter 192 is connected to a current source 196 for the emitter 126 by a current control line 198. The CPU 138 addresses the I/O buffer 190 by the address bus 162 and sends a value of current to the buffer 190 by data bus 158. The buffer 190 sends that value to the D/A converter 192 over the data line 194 and that value is converted by the D/A converter 192 to an analogue signal that is transmitted to the current source 196 by current control line 198 to supply a given current to the emitter 126.

As stated previously regarding the sensor 24, the amount of current that flows through the phototransistor 128 is a function of the amount of light to which a phototransistor is exposed. If the exposure to light is increased, more current will flow and if the exposure to light is decreased, less current will flow. There is maximum current flow across a resistor 170 when a sheet of paper is not between the emitter 126 and phototransistor 128 and the voltage difference between a ground 172 and the collector 130 of the phototransistor 128 is at its lowest value in this condition. The voltage difference between ground 172 and the collector 130 will increase when a sheet passes between the emitter 126 and phototransistor 128 in accordance with an increase in the thickness of a sheet since the amount of light to which a phototransistor is exposed decreases as the thickness of a sheet sensed increases.

Figure 7:
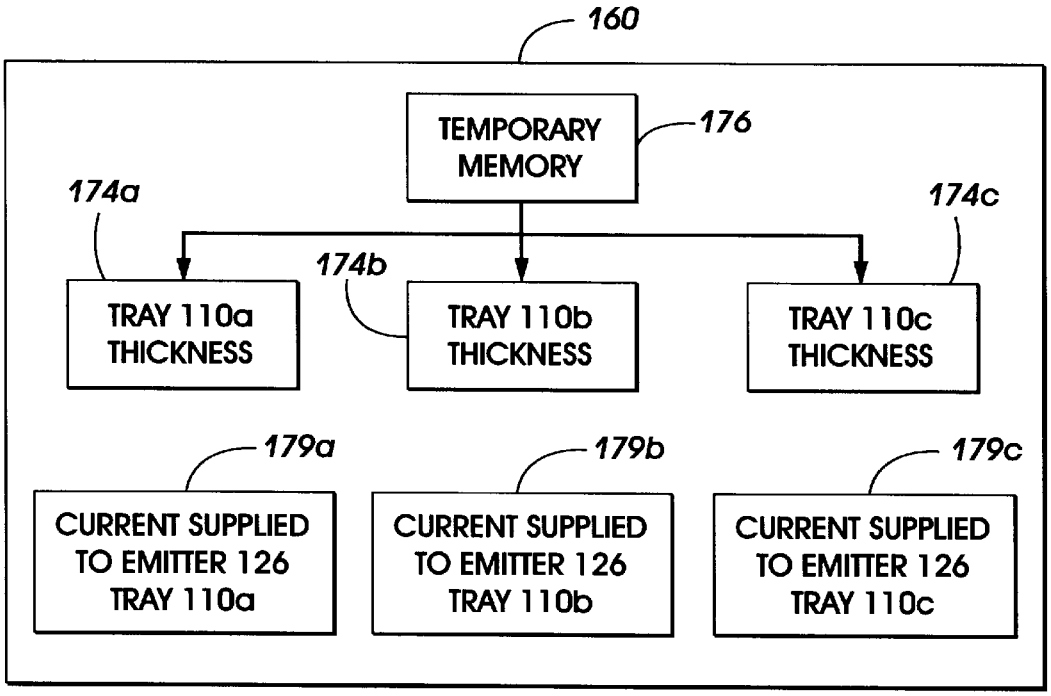
FIG. 7 is a block schematic diagram of a portion of a RAM memory of the schematic of FIG. 6.

The Ram section of the memory 160 is shown in FIG. 7. There are three memory locations 174*a*, 174*b* and 174*c* for storing the voltage response values (thickness value) at the phototransistor 128 for the sheets in each tray 110*a*, 110*b*, and 110*c*, respectively. The sensed thickness value of the first sheet fed from a particular tray is put into these locations for the particular tray from which a first sheet is fed. There is also a temporary memory location 176 for storing the sensed thickness value of all other sheets fed from the trays. Also provided are memory locations 179*a*, 179*b*, and 179*c* for storing the current value that is supplied to the emitter 126 for sensing sheets (other than the first sheet) fed from trays 110*a*, 110*b*, and 110*c*, respectively.

The same principle of this invention that was applied in the previous embodiment may be applied to this embodiment by setting up the system as follows: The CPU 138 is programmed to communicate to the I/O buffer 190 the value of 12 milliamps for the initial current to be supplied to the emitter 126 for the first sheet of paper 112*a*, 112*b* and 112*c* that is passed through the sensor 124. The CPU 138 is also programmed to supply a current of 12 milliamps to the emitter 126 for measuring the thickness of sheets that have a paper weight up to and including 50 lbs. and to supply a current of 25 milliamps to the emitter 126 for measuring the thickness of sheets that have a paper weight above 50 lbs. A voltage response value which corresponds to a voltage response at the phototransistor 128 for a sheet of a 50 lb. paper weight when 12 milliamps is supplied to the emitter 126 is stored in the EPROM. The EPROM contains a program which compares the voltage response value of the first sheet sensed from each tray 110*a*, 110*b*, and 110*c* with the stored voltage response value. If, for each respective tray, the voltage response of the first sheet is equal to or less than the stored value, the program will instruct the CPU 138 to input a value of 12 milliamps to the appropriate memory location 179*a*, 179*b*, or 179*c*. If, for each respective tray, the voltage response of the first sheet is above the stored value, the program will instruct the CPU 138 to input a value of 25 milliamps to the buffer 190 and to the appropriate memory location 179*a*, 179*b*, and 179*c* and instruct the feeder controller 168 to input a second sheet from the tray which had sheets heavier than 50 lbs. through the sensor 124 to obtain a voltage value when the emitter 196 is supplied with 25 milliamps.

The EPROM also contains a program for controlling measurement and storage of thickness values of the sheets 112*a*, 112*b*, and 112*c* arriving at the sensor 124 from the trays 110*a*, 110*b*, and 110*c* and for comparison of the thickness values for detecting double sheet feed from each of the trays 110*a*, 110*b* and 110*c*.

The CPU 138 is programmed to keep track of the sheets as they are fed from a particular tray until after they pass through the sensor 124 and place the sensed thickness values in the appropriate memory locations and compare the values corresponding to the appropriate sheets and trays. The CPU 138 is also programmed to address the appropriate memory location 179*a*, 179*b* or 179*c* for the appropriate tray from which a sheet has been fed to obtain the appropriate current to be supplied to the emitter 126 and transmit the value of the current to the I/O buffer 190 prior to the time that each sheet passes through the sensor 124.

Each tray 110*a*, 110*b*, and 110*c* has a sensor 178*a*, 178*b*, and 178*c* connected thereto for sensing when its respective tray has been lowered for refilling. The sensors 178*a*, 178*b*, and 178*c* are communicated to the CPU 138 by control lines 180*a*, 180*b*, and 180*c*, respectively. The sensor may be a contact switch, a push button switch or any other well known sensing device. When a tray is lowered, the sensor causes an interrupt through a respective control line at the CPU 138. The CPU 138 is programmed to respond to the interrupt to clear the appropriate memory location 174*a*, 174*b*, 174*c* for the tray that has been lowered and start the program for placing in the appropriate memory location for that tray the thickness value of the first sheet sensed that is fed from that tray after it is reloaded and to clear the I/O buffer 190 and send the value of the initial current of 12 milliamps to the I/O buffer 190 which is transmitted to the current source 196 to supply the emitter 126 with the initial current of 12 milliamps for measuring the thickness value of the first sheet sensed that is fed from the tray after it is reloaded.

In operation, the CPU 138 is programmed to transmit to the I/O buffer 190 the initial current value (12 milliamps) which is then transmitted to the current source 196 to supply 12 milliamps to the emitter 126. Referring to only sheets being fed from tray 110*a*, when a first sheet 112*a* is introduced into the sensor 124, there will be a sudden voltage change at the collector 130 which is sensed by the positive transition detector 140 which causes an interrupt through the control line 136 at CPU 138. The CPU 138 is programmed to only respond to the initial interrupt and ignore any subsequent interrupts until after the sheet of paper has left the sensor 124. In response to the initial interrupt, the CPU, in conjunction with the MMU 164, addresses the I/O buffer 142 which immediately resets the peak detector 134. As in the previous embodiment, the voltage at collector 130 is sampled six times as the sheet passes through the sensor 124.

The peak detector senses the voltage at collector 130 as the sheet passes between the emitter 126 and the phototransistor 128 with this voltage representing the thickness of the sheet. The voltage at the peak detector 134 is inputted to the A/D converter 150 in analogue form and this is converted to digital form by the A/D converter 150 and sent to the latch 146. The first sensing will be completed by a first sampling taken 22 milliseconds after entry of the sheet into the sensor 124. The latch will be set at 22 milliseconds to capture the peak voltage in peak detector 134 and the peak detector reset immediately thereafter for detecting the voltage over the next 1.4 inches of the sheet. Some time between the expiration of the first 22 milliseconds and the expiration of the next 22 milliseconds, the I/O buffer 142 will send the voltage information for the first sampling of the sheet to the memory 160. The same cycle is repeated until after the sixth 1.4 inch section is sampled. When a new sheet is introduced into the sensor 124, the sudden voltage change at the collector 130 is sensed by the positive transition detector 140 which causes an interrupt at the CPU 138 and the same cycle is repeated for the new sheet.

After the sixth 1.4 inch section of the sheet 112*a* is sampled while the sheet passes through sensor 124, the six sampled values of the first sheet 112*a* from the tray 110*a* are placed into memory location 174*a*. This thickness or voltage response value is compared to the voltage response value stored in the EPROM to determine if the paper weight of the sheet is at, below or above 50 lbs. to select the appropriate current to be supplied to the emitter 126 for sensing subsequent sheets. When the appropriate current value is selected, the CPU 138 is programmed to respond to such selection and input to the I/O buffer 190 the current value to be supplied to the emitter 26 for sensing subsequent sheets fed from tray 110*a*. If the current to be supplied to the emitter for sensing subsequent sheets is 12 milliamps, then the thickness value which was placed in memory location 174*a* will stay in that location as the thickness value for all of the remaining sheets in tray 110*a*. If the current to be supplied to the emitter for subsequent sheets is 25 milliamps, then the CPU 138 is programmed to clear the thickness value placed in memory location 174*a* and place the thickness value of the next sheet sensed by the sensor 124 in memory location 174*a*. The CPU 138 also inputs the appropriate current value in memory location 179*a* to be supplied to the emitter 126 for sensing subsequent sheets 112*a* from the tray 110*a*.

The thickness value sensed for all subsequent sheets fed from tray 110*a* will replace any thickness value in temporary memory 176 and that value will be compared to the thickness value in memory location 174*a*. The thickness value in memory location 174*a* will stay in memory location 174*a* until the tray 110*a* is lowered to refill the tray at which time the sensor 178*a* will cause an interrupt through control line 180*a* at the CPU 138 and the current thickness value is cleared from memory location 174*a*. The thickness value sensed by sensor 124 of either the first or second sheet fed (depending upon whether 12 milliamps or 25 milliamps is supplied to the emitter 126 for subsequent sheets) from the tray 110*a*, after the tray 110*a* has been refilled and after the memory location 174*a* has been cleared, will be placed into the memory location 174*a* as the new thickness value for all of the remaining new sheets 112*a* loaded onto tray 110*a*. The current value for emitter 126 in memory location 179*a* will stay in memory location 179*a* until the tray 110*a* is lowered to refill the tray at which time the CPU 138, in response to the interrupt through control line 180*a*, will clear the value from the memory location 179*a* and place the initial amount of current (12 milliamps) in memory location 179*a*. The proper current to be supplied to the emitter 126 for the new sheets 112*a* loaded onto tray 110*a* will be placed into memory location 179*a* after the first sheet from the reloaded tray is sensed by sensor 124.

When a subsequent sheet 112*a* is fed from the tray 110*a*, it is sensed by sensor 124 in the same manner as the first sheet was and after the sixth 1.4 inch section of a sheet 112*a* is sampled while the sheet passes through sensor 124, the sum of the six sampled values of the sheet are temporarily placed into memory location 176 and those values are compared with the sum of the six sampled values of the first sheet from the tray 110*a* that are in memory location 174*a*. This can be achieved by comparing the sum of the six sensed values in memory location 176 with the sum of the six sensed values in memory location 174*a*. If the sums are within a chosen tolerance of each other, it will be assumed that only one sheet has passed through the sensor 124 and normal operation of the printing system will continue. If the sum of the six sensed values, which is located in memory location 174*a*, for the first sheet is less than the sum of the six sensed values, located in memory location 176, of a subsequent sheet fed from tray 110*a* by more than a chosen tolerance, then such will indicate a greater sheet thickness for the subsequent sheet than the first sheet. Thus, it will be assumed that more than one sheet has passed through the sensor 124 and a signal will be sent by the CPU 138 over the control line 166 to the feeder controller 168 to immediately stop the sheet feeding system. A system operator can then remove the double fed sheets and reset the system to resume normal operation. Alternatively, in response to the signal, the offending sheets can be sent to a purge tray at the printer without stopping the sheet feeding system.

When a first sheet 112*b* or 112*c* is fed from respective trays 110*b* or 110*c*, the sheet will be sensed by sensor 124 in the same manner as the sheet 112*a* is sensed by sensor 124 and it will be determined that either 12 milliamps or 25 milliamps will be supplied to the emitter 126 when the sheets 112*b* and 112*c* pass through sensor 124. The appropriate thickness value against which subsequent sheets will be compared will be determined by the measurement on the first sheet from the tray if 12 milliamps is to be supplied to the emitter 126 for sensing the subsequent sheets from that tray or by the measurement on the second sheet from a tray if 25 millamps is to be supplied to the emitter 126 for sensing the subsequent sheets from that tray.

The thickness value sensed by sensor 124 for the first or second sheet, whichever is applicable, fed from each tray 110*b* and 110*c* will be placed in the appropriate memory location 174*b* for tray 110*b*, as the thickness value for all of the remaining sheets in tray 110*b*, or in memory location 174*c* for tray 110*c* as the thickness value for all of the remaining sheets in tray 110*c*. The thickness value in memory location 174*b* will stay in memory location 174*b* until the tray 110*b* is lowered to refill the tray at which time the sensor 178*b* will cause an interrupt through control line 180*b* at the CPU 138 and the current thickness value is cleared from memory location 174*b*. The thickness value sensed by sensor 124 of either the first or second sheet fed (depending upon whether 12 milliamps or 25 milliamps is supplied to the emitter 126 for subsequent sheets) from the tray 110*b*, after the tray 110*b* has been refilled and after the memory location 174*b* has been cleared, will be placed into the memory location 174*b* as the new thickness value for all of the remaining new sheets 112*b* loaded onto tray 110*b*. The thickness value in memory location 174*c* will stay in memory location 174*c* until the tray 110*c* is lowered to refill the tray at which time the sensor 178*c* will cause an interrupt through control line 180*c* at the CPU 138 and the current thickness value is cleared from memory location 174*c*. The thickness value sensed by sensor 124 of either the first or second sheet fed (depending upon whether 12 milliamps or 25 milliamps is supplied to the emitter 126 for subsequent sheets) from the tray 110*c*, after the tray 110*c* has been refilled and after the memory location 174*c* has been cleared, will be placed into the memory location 174*c* as the new thickness value for all of the remaining new sheets 112*c* loaded onto tray 110*c*.

The current value for emitter 126 in memory location 179*b* will stay in memory location 179*b* until the tray 110*b* is lowered to refill the tray at which time the CPU 138, in response to the interrupt through control line 180*b*, will clear the value from the memory location 179*b* and place the initial amount of current (12 milliamps) in memory location 179*b*. The current value for emitter 126 in memory location 179*c* will stay in memory location 179*c* until the tray 110*c* is lowered to refill the tray at which time the CPU 138, in response to the interrupt through control line 180*c*, will clear the value from the memory location 179*c* and place the initial amount of current (12 milliamps) in memory location 179*c*. The proper current to be supplied to the emitter 126 for the new sheets 112*b* loaded onto tray 110*b* will be placed into memory location 174*b* after the first sheet from the reloaded tray 110*b* is sensed by sensor 124. The proper current to be supplied to the emitter 126 for the new sheets 112*c* loaded onto tray 110*c* will be placed into memory location 174*c* after the first sheet from the reloaded tray 110*c* is sensed by sensor 124.

The thickness value sensed for all subsequent sheets fed from tray 110*b* will replace any thickness value in temporary memory location 176 and that value will be compared to the thickness value in memory location 174*b*. The thickness value sensed for all subsequent sheets fed from tray 110*c* will replace any thickness value in temporary memory location 176 and that value will be compared to the thickness value in memory location 174*c*. The comparison will be done in the same manner as the comparison for the values of the subsequent sheets 112*a* that are fed from tray 110*a*.

The proper current value has to be supplied to the emitter 126 of the sensor 124 to sense subsequent sheets fed from a particular tray under the same conditions that the thickness value of the first or second sheet from that tray was sensed and which reside in memory locations 174*a*, 174*b*, and 174*c*. When each of the subsequent sheets are fed from a tray and are introduced into sensor 124, there will be a sudden voltage change at the collector 130 which is sensed by the positive transition detector 140 which causes an interrupt through the control line 136 at CPU 138. In response to the initial interrupt the CPU 138, in conjunction with the MMU 164, addresses the corresponding memory location 179*a*, 179*b*, 179*c* to obtain the pertinent current value to be supplied to the emitter 126 for sensing the sheet when it passes through sensor 124. The current value is sent to the I/O buffer 190 which causes the current source 196 to supply that current value to the emitter 126 for sensing the sheet just introduced into the sensor 124.

It should be understood that the selection of 12 milliamps and 25 milliamps as the operating currents for the emitters and for generating the curves in FIG. 3 is for illustrative purposes only. Other magnitudes of current can be selected depending upon the desirable voltage response specifications of the system, the response characteristics between the emitter and phototransistor and other factors.

Figure 6:
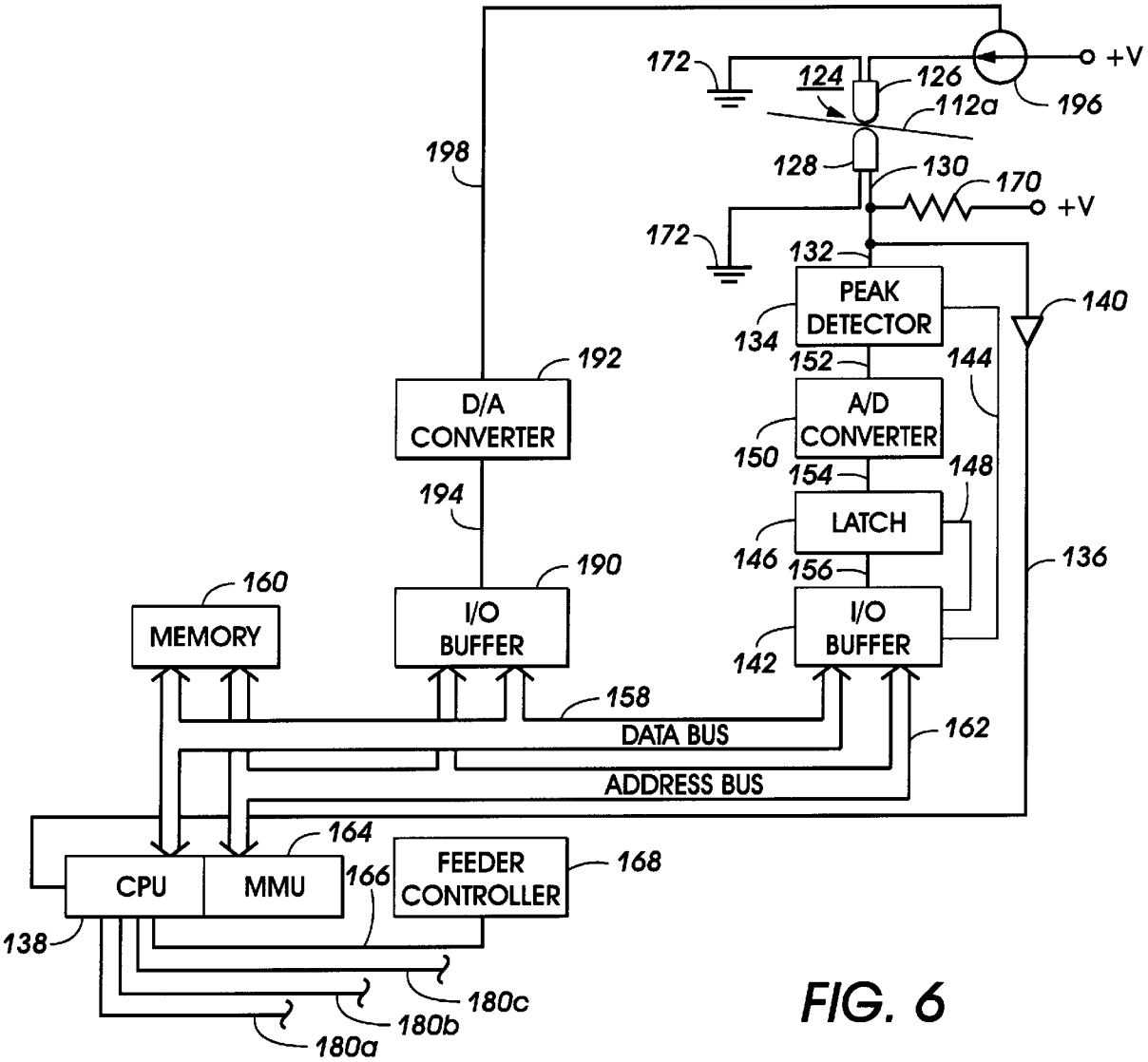
FIG. 6 is a block schematic diagram of a multi-sheet feed detector operating system embodying this invention for the printing system illustrated in FIG. 5.
Figure 8:
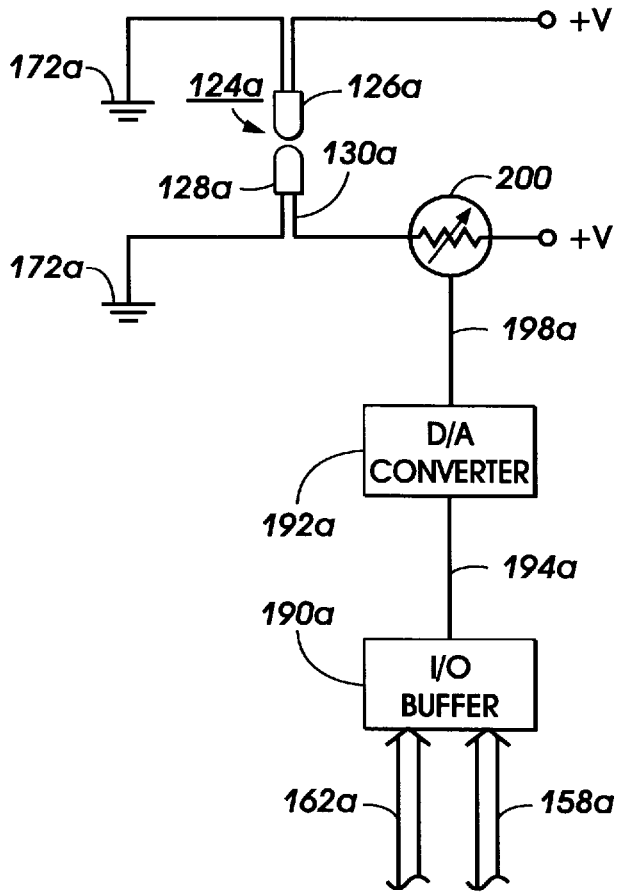
FIG. 8 is a modified block schematic diagram of the embodiment of FIGS. 5–7.

Rather than control the amount of current supplied to the emitter of a sensor to provide the desired voltage response at the sensor, resistance in a phototransistor collector circuit can be varied to provide the desired voltage response condition. A simplified schematic illustrating this principle is shown in FIG. 8. All elements that are the same as shown in the embodiment illustrated in FIG. 6 are represented by the same reference numerals, only with an "a" affixed thereto. The fixed resistor 170 of the schematic shown in the embodiment of FIG. 6 is replaced by variable resistor 200. The resistance of resistor 200 can be varied by any well known circuit means. As in the previous embodiment, the voltage response at the collector 130*a* of sensor 124*a* increases with an increase in paper weight since less current flows from the phototransistor 128*a* through the resistor 200. Since more current flows through the resistor 200 when lighter sheets are sensed by the sensor 124*a* than when heavier sheets are sensed, the resistance must be decreased to increase the voltage response at the collector 130*a*. Since less current flows through the resistor 200 when heavier sheets are sensed by the sensor 124*a* than when lighter sheets are sensed, the resistance must be increased to decrease the voltage response at the collector 130*a*.

Accordingly, in order to have a voltage response at a sensor which is higher, when the sensor is in the first condition and sensing a sheet of a given paper weight than it will have when in a second condition and sensing a sheet of the same paper weight, the resistance value of the resistor has to be higher when the sensor is in the first condition than the resistance value of the resistor when the sensor is in the second condition.

When calibrating the sensor 124*a* to sense sheets in each range of paper weight values, a voltage response can be selected for a sheet of a paper weight of 20 lbs. and such sheet is passed through each sensor 124*a*. The resistance of resistor 200 will be adjusted to provide the desired voltage response at sensor 124*a*. Then a voltage response can be selected for a sheet of a paper weight of 60 lbs. and such sheet is passed through sensor 124*a*. The resistance of resistor 200 will be adjusted to provide the desired voltage response at sensor 124*a*. The calibration can be performed manually.

The operation of the system described will be the same, only instead of current values being changed at the sensor 124, resistance values will be changed at the sensor 124*a*. For instance, the CPU 138*a* will be programmed to provide a first resistance value at the resistor 200 for measuring the thickness of sheets that have a paper weight up to and including 50 lbs. and to supply a second resistance value, which is higher than the first resistance value, at the resistor 200 for measuring the thickness of sheets that have a paper weight above 50 lbs. The I/O buffer 190*a* will be controlled to transmit resistance values to the variable resistor 200, instead of I/O buffer 190 transmitting current values in the previous embodiment. Memory locations 179*a*, 179*b* 179*c* will be used to store the appropriate resistance values to be used for each sheet instead of storing the current values of the previous embodiment.

In following the main principle of this invention, more than two ranges of paper weights can be selected. A different voltage response condition for the sensor can be set for each of the paper weight ranges as long as the sensor, when in a voltage response condition for sensing sheets from a range that encompasses sheets that are heavier than the sheets in another range, will have a voltage response which is lower than when the same sensor senses a sheet of the same paper weight, when the sensor is in a given voltage response condition for sensing sheets in another range.

Instead of comparing sums of values as described for both embodiments, each value sampled at the sensors 24 and 124 for the first sheet fed from a tray can be compared with each corresponding value sampled for a subsequent sheet fed from the same tray. If a certain number of values match within a given tolerance, it will be assumed that only one sheet passed through the sensors. For instance, if four of the six sensed values match, it will be assumed that only one sheet passed through the sensor. In this case, the sum of the samplings at the sensors 24, 124 for the first sheet sensed from each tray could still be used for comparison with the thickness value stored in the EPROM to determine the current value to be used at the emitters 26, 126 for sensing subsequent sheets fed from that tray. Obviously, other ways of comparing values can be used and the number of samplings can be changed to a particular situation desired. The comparison function can be conducted as a new sheet is fed from any tray into its respective sensor. This way, the system is not held up while a comparison is being made.

The system described is based upon assuming that the first and second sheets (the thickness value of which is relied upon as representative of the thickness value for the remaining sheets from a corresponding tray) from a tray 10*a*, 10*b* and 10*c* are truly single sheets and are not double sheets. This system could be modified to detect double sheets being fed as such a first or second single sheet from a tray. For instance, if such first or second sheet fed from a tray is a double fed sheet, a subsequent sheet fed from that tray will be sensed to have a lower voltage response beyond a given tolerance than the first or second sheet indicating the first or second sheet was a double fed sheet. The system will be stopped, the double fed sheets removed and the first or second fed sheet sensing reinitiated.

The system and the electronic components thereof have been described in general. It should be realized that well known programming techniques and off-the-shelf hardware are all that is required to achieve the principles of this invention. Thus someone with ordinary skill in the art will be able to construct the system described.

We claim:

1. In a sheet transport system comprising:

a. a first tray for supporting a stack of sheets, b. a second tray for supporting a stack of sheets, c. a sensor located to sense a thickness or paper weight value of each sheet discharged from each of said trays, d. said sensor comprising an emitter and a phototransistor being so constructed and arranged to receive sheets therebetween, e. said emitter emitting light rays towards said phototransistor, f. said sensor having voltage response in accordance with the amount of light sensed by said phototransistor, g. condition changing means operably connected to said sensor for changing the conditions of voltage response of said sensor, h. said conditions of voltage response being at least one condition for sensing sheets of a first given range of sheet thickness or paper weight value and a second condition for sensing sheets of a second given range of sheets that are thicker or heavier value than said first given range, i. said sensor having a voltage response when in said one condition that is higher for a sheet of a given thickness or paper weight value than the voltage response for a sheet of the same given thickness or paper weight value when said sensor is in said second condition, j. means for storing in memory a thickness or paper weight value sensed by said sensor of a given sheet from each of said trays, k. said condition changing means for said sensor being responsive to a signal indicating a thickness or paper-weight value of a sheet to be received by said sensor to set the condition of voltage response for said sensor in accordance with the given range of thickness or paper weight value corresponding to the thickness or paper weight value of the remaining sheets to be received from said trays, l. means for comparing the thickness or paper weight value sensed by said sensor of each of the remaining sheets from said first tray with the thickness or paper weight value in memory sensed by said sensor of the given sheet from said first tray, when said sensor was in the same voltage response condition corresponding to the given range of thickness or paper weight value for sensing the remaining sheets of said first tray, and generating a signal indicating a misfeed if the values differ by a predetermined amount, and m. means for comparing the thickness or paper weight value sensed by said sensor of each of the remaining sheets from said second tray with the thickness or paper weight value in memory sensed by said sensor of the given sheet from said second tray, when said sensor was in the same voltage response condition corresponding to the given range of thickness or paper weight value for sensing the remaining sheets of said second tray, and generating a signal indicating a misfeed if the values differ by a predetermined amount.

2. In a sheet transport system of claim 1 wherein said condition changing means comprises means for changing a current supplied to said emitter with a first given current being supplied to said emitter when said sensor is in said one condition and a second given current, which is greater than the first given current, being supplied to said emitter when said sensor is in said second condition.

3. In a sheet transport system of claim 1 further comprising:

a. said phototransistor having a collector, b. a voltage source, c. electrical resistance means operably connected to said voltage source and said collector, and d. said condition changing means comprising means for changing the resistance of said electrical resistance means with a first given resistance value being supplied by said electrical resistance means when said sensor is in said one condition and a second given resistance value, which is greater than the first given resistance value, being supplied by said electrical resistance means when said sensor is in said second condition.

* * * * *